US006304741B1

(12) United States Patent
Tange

(10) Patent No.: US 6,304,741 B1
(45) Date of Patent: Oct. 16, 2001

(54) IMAGE FIXING APPARATUS AND IMAGE FORMING APPARATUS USING THE SAME

(75) Inventor: Keigo Tange, Okazaki (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/613,504

(22) Filed: Jul. 10, 2000

(30) Foreign Application Priority Data

Jul. 12, 1999 (JP) ..... 11-198085

(51) Int. Cl.[7] ..... G03G 15/20
(52) U.S. Cl. ..... 399/328; 219/216; 399/333
(58) Field of Search ..... 399/328, 330, 399/331, 333; 219/216, 469, 388, 243; 430/99, 124; 347/156; 432/59

(56) References Cited

U.S. PATENT DOCUMENTS 5,253,027 * 10/1993 Goto ..... 399/333
5,708,920 * 1/1998 Ohnishi et al. ..... 399/69
6,144,833 * 11/2000 Ito et al. ..... 399/328

FOREIGN PATENT DOCUMENTS 10-97150 4/1998 (JP) .
10-301417 * 11/1998 (JP) .

* cited by examiner

*Primary Examiner*—Sophia S. Chen
(74) *Attorney, Agent, or Firm*—McDermott, Will & Emery

(57) ABSTRACT

An image fixing apparatus is formed by a fixing roller which contacts an image surface of a recording mediums and performs fixing, a pressure roller which is urged against the fixing roller to thereby apply a necessary pressure needed for fixing of a toner image upon the recording medium, and an external heating roller which has an internal heat surface and when urged against the fixing roller, keeps a surface layer of the fixing roller at a predetermined temperature which is necessary for fixing. A heat transfer coefficient of the fixing roller is 20 $W/m^2 \cdot K$ to 100 $W/m^2 \cdot K$. This guarantees a necessary fixing nip width which is needed for fixing of images without increasing the size of the apparatus or remarkably increasing a holding pressure at the fixing nip portion. Further, it is possible to stably maintain an appropriate fixing temperature without increasing the temperature gradient of the surface layer portion for adding a filler material to the surface layer. In an image forming apparatus using such an image fixing apparatus, stable and high-quality fixing of images one at a time not to mention, but also even continuously is realized.

16 Claims, 4 Drawing Sheets

IMAGE FIXING APPARATUS AND IMAGE FORMING APPARATUS USING THE SAME

The present application claims priority to Japanese Patent Application No. 11-198085 filed Jul. 12, 1999, the entire content of which is hereby incorporated by reference.

BACKGROUND OF THE INVENTION

1. Field of the Invention

The present invention relates to an image fixing apparatus for use in an image forming apparatus such as a copier machine, a printer, a facsimile machine and a hybrid machine which combines two or more of these three.

2. Description of the Related Art

In an image forming apparatus of an electrophotographic method such as a copier machine and a printer, a surface of a photosensitive member which is an image carrier is electrified, an image is exposed in the electrified area to thereby form an electrostatic latent image, the electrostatic latent image is developed into a visualized toner image, the toner image is transferred onto a recording medium such as a recording paper, and an image fixing apparatus fixes the toner image. Meanwhile, in an image forming apparatus of a direct recording method, a toner is blown in accordance with a received image signal onto a recording medium such as a recording paper from a line of toner supply holes which are formed in a hopper which contains the toner to thereby directly form a visualized toner image without forming an electrostatic latent image, and an image fixing apparatus fixes the visualized toner image. An image fixing apparatus as such usually comprises a fixing roller which contacts an unfixed toner image on a recording medium and a pressure roller which is urged against the fixing roller under pressure and accordingly rotates. The unfixed toner image is subjected to heat and a pressure together with the recording medium while transporting the recording medium carrying the toner image in a nip portion between the two rollers, whereby the toner image is fixed on the recording medium.

Known as a method of heating the fixing roller are a method which requires to heat up the fixing roller from inside by a heater which is disposed inside the fixing roller and a method which requires to heat up the fixing roller from outside by means of a heater which is disposed outside the fixing roller. As compared with the method requiring to heat up the fixing roller from inside, the method requiring to heat up the fixing roller from outside is characterized in that it is possible upon startup of a fixing apparatus to shorten a time which is necessary to increase a temperature of the surface of the fixing roller to an appropriate temperature for fixing and in that when a large number of record images are to be outputted continuously, it is possible to quickly increase a temperature of the surface of the fixing roller which tends to decrease due to heat stolen by the recording medium which moves passing the fixing apparatus. Another characteristic is that it is possible to ensure a wider nip width, as a surface layer of the fixing roller is thickened.

However, the method heating up the fixing roller from outside demands to preliminarily operate the fixing apparatus before a paper arrives, for the purpose of increasing a temperature of the fixing roller to a temperature which is needed for fixing. Hence, when a material whose heat transfer coefficient is large is used for the surface layer of the fixing roller, heat flows into a roller base and escapes, and therefore, a long time is needed until a temperature of the surface of the fixing roller increases to a temperature which enables fixing since an image formation start signal is sent.

On the other hand, when a material, such as an expanded rubber, whose thermal conductivity is low is used for the surface layer in an effort to decrease the heat transfer coefficient and accordingly quickly increase a temperature of the fixing roller, a temperature of the surface layer of the fixing roller decreases at a rear end of a recording paper which travels through the fixing apparatus, thereby causing a large difference in gloss of an image within the same recording paper, defective fixing on the rear end side, etc.

SUMMARY OF THE INVENTION

An object of the present invention is to provide an image fixing apparatus which shortens a preliminary operation time.

Another object of the present invention is to provide an image forming apparatus which realizes stable and high-quality fixing of images one at a time not to mention, but also even continuously.

These and other objects are achieved by an image fixing apparatus for fixing a toner image on a recording medium, comprising: a fixing member whose heat transfer coefficient in the direction of thickness is 20 $W/m^2 \cdot K$ to 100 $W/m^2 \cdot K$ and which contacts said toner image; and a heater which heats said fixing member from outside.

The fixing member is typically a roller or a belt. That is, examples of the fixing member include a fixing roller and a fixing belt. A fixing roller may be solid or hollow.

Where the fixing member is a solid roller, a heat transfer coefficient of the fixing member in the direction of thickness is a heat transfer coefficient of a portion along the thickness from the center of the roller to a surface taken in the direction of a diameter, and where the fixing member is a hollow roller or a fixing belt, the heat transfer coefficient is a heat transfer coefficient measured at a thick portion of the roller or a thick belt portion. The following relationship holds between the thickness t of the fixing member, a heat transfer coefficient H and a thermal conductivity h:

$$H=h/t$$

The objects above are achieved also by an image fixing apparatus for fixing a toner image on a recording medium, comprising: a fixing member which includes an elastic material layer whose heat transfer coefficient is 20 $W/m^2 \cdot K$ to 100 $W/m^2 \cdot K$ and which contacts said toner image; and a heater which heats said fixing member from outside.

The elastic material layer may be formed on a surface of a solid or hollow core roller of metal which has an excellent thermal conductivity, such as iron and aluminum, in a case that the fixing member is of a roller type. Where the fixing member is of a belt type, the elastic material layer may be formed on a surface of a belt of metal which has an excellent thermal conductivity such as iron and aluminum.

The image fixing apparatus according to the present invention is based on the following findings of the inventor. That is, when a toner image is fixed on a recording medium, fixing becomes strong when a temperature of the recording medium after fixing is somewhere around 100° C., and particularly strong when the temperature is on the higher end in that range. Further, when a heat transfer coefficient of the fixing member taken in the thickness direction or a heat transfer coefficient of the elastic material layer which forms a surface layer of the fixing member is 20 $W/m^2 \cdot K$ to 100 $W/m^2 \cdot K$, a surface temperature of a recording medium immediately after fixing tends to be around 100° C. A surface temperature of a recording medium is particularly high when a heat transfer coefficient is 30 $W/m^2 \cdot K$ to 60

$W/m^2 \cdot K$. More specifically, an optimal heat transfer coefficient of the fixing member or the elastic material layer is 20 $W/m^2 \cdot K$ to 100 $W/m^2 \cdot K$, and more preferably, 30 $W/m^2 \cdot K$ to 60 $W/m^2 \cdot K$. In short, it is desirable to use a material (e.g., a heat transfer coefficient) and a structure (the thickness of the surface layer) which, due to heat from outside, can hold a necessary quantity of heat in the vicinity of the surface layer and do not easily allow diffusion of a large quantity of heat inwardly.

The objects above are achieved alternatively by an image fixing apparatus for fixing a toner image on a recording medium, comprising: a fixing member which includes a first layer having an elasticity whose heat transfer coefficient is 50 $W/m^2 \cdot K$ or smaller and a second layer whose heat transfer coefficient is 60 $W/m^2 \cdot K$ or higher and which is formed on said first layer, said fixing member being in contact with said toner image; and a heater which heats said fixing member from outside.

Using the first and the second layers as such makes it easier for a surface layer portion of the fixing member to hold heat, but more difficult to diffuse heat.

The first layer may be formed on a surface of a solid or hollow core roller of metal which has an excellent thermal conductivity, such as iron and aluminum, in a case that the fixing member is of a roller type. Where the fixing member is of a belt type, the first layer may be formed on a surface of a belt of metal which has an excellent thermal conductivity such as iron and aluminum.

In order to make it more difficult for heat to escape to the lower layer during heating of the surface of the fixing roller from outside, a heat transfer coefficient of the first layer is preferably as small as possible, and more preferably, 30 $W/m^2 \cdot K$ or smaller. Meanwhile, a heat transfer coefficient of the second layer is preferably as large as possible, and more preferably, 600 $W/m^2 \cdot K$ or larger, so that the second layer is heated up swiftly to a fixing temperature.

Where the fixing member has a stacked structure of the first layer to an n-th layer, a heat transfer coefficient H of the fixing member is expressed as below:

$$1/H = 1/H1 + 1/H2 + \ldots + 1/Hn$$

Where Hn: a heat transfer coefficient of the n-th layer.

The image fixing apparatuses as described above can ensure a nip width necessary for fixing of an image without increasing the size of the apparatus and inviting a remarkable increase in a pushing force at the fixing nip portion, and hence, continuously and stably fix images at an appropriate fixing temperature without increasing a temperature gradient of the surface layer (i.e., without creating an extremely high temperature portion inside the surface layer) or adding a filler material to the surface layer. This makes it possible to continuously and stably fix images with a high quality.

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawings.

DETAILED DESCRIPTION OF THE PREFERRED EMBODIMENTS

Now, preferred embodiments of the present invention will be described with reference to the associated drawings.

Figure 1:
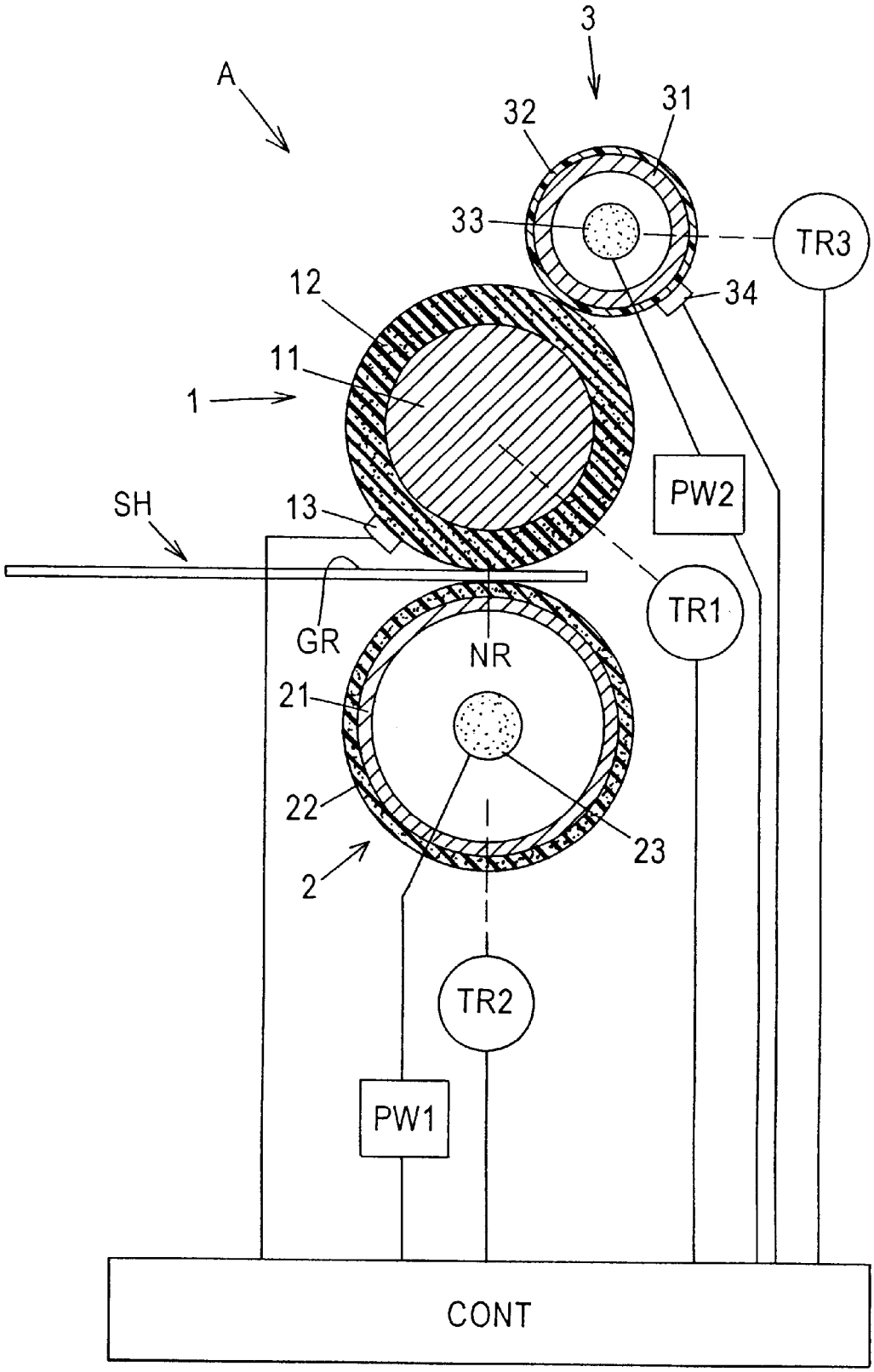
FIG. 1 is a schematic structure diagram showing one example of an image fixing apparatus according to the present invention.

FIG. 1 shows one example of a schematic structure of an image fixing apparatus according to the present invention.

An image fixing apparatus A shown in FIG. 1 is mounted in its entirety to an image forming apparatus which is also shown but not entirely, and comprises a fixing roller 1 which contacts an image surface GR of a recording mediums SH and performs fixing, a pressure roller 2 which is urged against the fixing roller 1 to thereby apply a necessary pressure needed for fixing of a toner image upon the recording medium SH, and an external heating roller 3 which internally comprises a heat source, contacts the fixing roller 1 and keeps a surface layer of the fixing roller 1 at a predetermined temperature which is necessary for fixing.

A silicon rubber layer 12 whose thickness is 3 mm and whose thermal conductivity is 0.1 $W/m \cdot K$ is formed on a solid roller base 11 of iron whose diameter is 24 mm, thereby defining the fixing roller 1. A heat transfer coefficient of the fixing roller 1 is 33 $W/m^2 \cdot K$.

A driving apparatus TR1 is connected to the fixing roller 1, and a temperature sensor 13 for measuring a temperature of the silicon rubber layer 12 is also disposed to the fixing roller 1.

The pressure roller 2 comprises an elastic layer 22 of a silicon rubber whose thickness is 2 mm on a surface of a hollow roller base 21 of aluminum whose diameter is 26 mm.

The pressure roller base 21 has a shape of a pipe whose inner diameter is 20 mm. Inside the pressure roller base 21, an auxiliary halogen lamp heater 23 is disposed. Further, a driving apparatus TR2 is connected to the pressure roller 2. Urged against the fixing roller 1 by a pressure contact apparatus not shown, the pressure roller 2 defines a contact nip portion NR.

A fluorine resin layer (polytetrafluoroethylene layer) 32 is sintered into a thickness of approximately 30 $\mu m$ on a pipe-shaped base 31 of aluminum whose outer diameter is 24 mm and inner diameter is 20 mm, thereby defining the external heating roller 3. Inside the external heating roller 3, a halogen lamp heater 33 is disposed as a heat source. A driving apparatus TR3 is connected to the external heating roller 3, and the external heating roller 3 comprises a temperature sensor 34 for measuring a surface temperature of the fluorine resin layer 32. Like the pressure roller 2, the external heating roller 3 is urged against the fixing roller 1 by a pressure contact apparatus not shown.

Temperatures of the respective halogen lamp heaters 23 and 33 are adjusted by controlling output power of power sources PW1 and PW2 which supply electric power respectively to the halogen lamp heaters 23 and 33.

The respective driving apparatuses TR1, TR2 and TR3 and the power sources PW1 and PW2 of the halogen lamp heaters 23 and 33 operate based on instructions given from a control apparatus CONT of the overall image forming apparatus. Temperature information detected by the temperature sensors 13 and 34 are fed to the control apparatus CONT.

As the image forming apparatus is turned on, the control apparatus CONT instructs the power sources PW1 and PW2 to supply electric power to the lamp heaters 23 and 33 to thereby increase temperatures of the pressure roller 2 and the external heating roller 3, and instructs the driving apparatuses TR1, TR2 and TR3 to rotate the fixing roller 1, the pressure roller 2 and the external heating roller 3. When a temperature at the surface of the fixing roller 1 detected by the fixing roller temperature sensor 13 reaches a predetermined temperature, rotation of each roller is stopped. The respective rollers 1, 2 and 3 are rotated once again upon arrival of a print start signal at the control apparatus CONT, and printing is started if a temperature of the silicon rubber layer 12 of the fixing roller 1 detected by the temperature sensor 13 is already a temperature which is needed for fixing of an image. If the temperature which is needed for fixing of an image is yet to be achieved, heat generation by the halogen lamp heater 33 of the external heating roller 3 is increased, whereby the silicon rubber layer 12 of the fixing roller 1 is heated up to the predetermined temperature which is necessary for image fixing. A temperature of the external heating roller 3 itself is controlled based on temperature information detected by the temperature sensor 34.

Meanwhile, the halogen lamp heater 23 is used for supplementary heating of the silicon rubber layer 12 when the silicon rubber layer 12 of the fixing roller 1 is at a very low temperature as compared with the predetermined fixing temperature as immediately after power turn-on, for instance, and therefore it takes time to increase a temperature of the silicon rubber layer 12 only with the halogen lamp heater 33 of the external heating roller 3. Hence, the pressure roller 2 also serves as an auxiliary external heating roller in this embodiment.

After the start of printing, a transported recording medium SH which seats a toner image formed by an image forming portion not shown is held in the nip portion NR which is formed between the fixing roller 1 and the pressure roller 2 which is urged against the fixing roller 1, pressurized and heated, whereby the toner image is fixed.

Further, for continues printing, rotation of the respective rollers and operations of the halogen lamp heater 33 within the external heating roller 3 are not stopped even during an interval between printing at one point and subsequent printing, so that a temperature of the silicon rubber layer 12 of the fixing roller 1 is maintained at the predetermined temperature which allows fixing and toner images are successively fixed to recording media one after another. At this stage, if a temperature of the silicon rubber layer 12 is yet to reach the predetermined temperature which is needed for fixing of an image despite heating of the silicon rubber layer 12 of the fixing roller 1 by means of the external heating roller 3, the halogen lamp heater 23 of the pressure roller 2 is activated to thereby keep the silicon rubber layer 12 at the predetermined temperature.

Now, a description will be given on the executed experiment in which the image fixing apparatus A showed an excellent image fixing capability.

Prepared as an image fixing apparatus for comparison was an apparatus whose structure was similar to the fixing apparatus shown in FIG. 1 except for that instead of the silicon rubber layer 12 of the fixing roller 1, a fixing roller which had a heat transfer coefficient of 150 $W/m^2 \cdot K$ and comprised a silicon rubber layer whose thermal conductivity was 0.3 W/m·K and whose thickness was 2 mm. In each one of the apparatus shown in FIG. 1 and the test apparatus for comparison, the nip portion NR, wherein the fixing roller and the pressure roller 2 were in mutual contact with each other, had a width of 4 mm. In addition, a nip width between the fixing roller and the external heating roller 3 was set to 3 mm.

For each fixing apparatus, after heating up the pressure roller 2 and the external heating roller 3 to 170° C., each roller was rotated prior to fixing for 15 seconds at a circumferential speed of 80 mm/sec. Normal papers each seating a toner image whose weighing capability was 80 $g/m^2$ were thereafter fed passing through, eight papers per minute, at a paper travel speed of 80 mm/sec. Post-fixing images were similarly rubbed with an eraser, and image density ratios between before and after the rubbing were calculated to thereby identify a fixing strength. As a result, it was found that each one of the images fixed with the apparatus shown in FIG. 1 had a fixing strength of 85% or higher. This means that the apparatus shown in FIG. 1 realizes excellent fixing of images. On the other hand, some of the images fixed with the test apparatus for comparison showed a fixing strength not exceeding 60%, showing a remarkable difference in terms of a fixing capability between the two apparatuses.

Further, surface temperatures of the fixing rollers were measured using a radiation thermometer immediately before starting to feed papers. While the measured temperature was more than 150° C. in the apparatus shown in FIG. 1, the measured temperature was 130° C., which is lower, in the test apparatus for comparison.

For calculation of a fixing strength, first, a density of a fixed toner image is measured with an image reflection density measuring unit (RD-918, available from Macbeth). After reciprocally moving a sand eraser (No. 502, available from Lion) on the image under a load of 1 kg, an image reflection density is measured. A ratio of the latter image density to the precedent image density is calculated, whereby a fixing strength is calculated.

The elastic layer 22 of the pressure roller 2 may mount an oil barrier layer or the like against oil which may be applied for the purpose of preventing offset of a toner to the base layer and the roller.

Next, a schematic structure of other example of an image fixing apparatus according to the present invention will be described.

Figure 2:
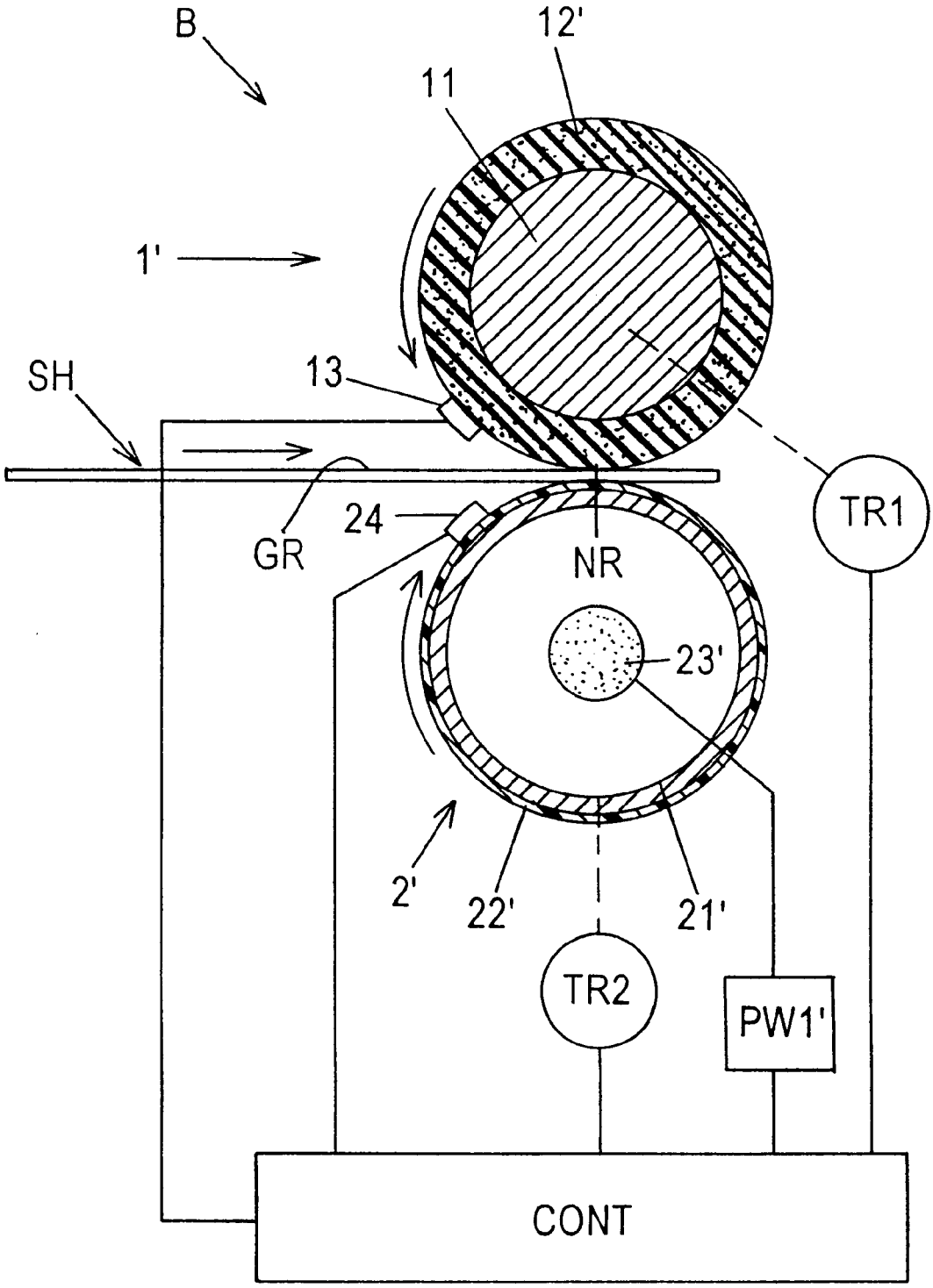
FIG. 2 is a schematic structure diagram showing other example of an image fixing apparatus according to the present invention.

An image fixing apparatus B shown in FIG. 2 comprises a fixing roller 1 which contacts an image surface GR of a recording mediums SH and performs fixing, and a pressure roller 2' which is urged against the fixing roller 1' to thereby apply a necessary pressure needed for fixing of a toner image upon the recording medium SH. The pressure roller 2' internally has a heat source, and contacts the fixing roller 1' to thereby maintain a surface of the fixing roller 1' at a temperature which is needed for image fixing. The pressure roller 2' also serves as an external heating roller for heating the fixing roller 1'.

Identical reference symbols are assigned to portions which are substantially the same as those of the image fixing apparatus A. As in the image fixing apparatus A, the fixing roller 1' comprises an elastic layer 12' of a silicon rubber whose thickness is 3.00 mm and whose thermal conductivity is 0.1 W/m·K which is formed on a surface of the solid roller base 11 of iron whose diameter is 24 mm. A heat transfer coefficient of the fixing roller 1' is 35 $W/m^2 \cdot K$.

The driving apparatus TR1 is connected to the fixing roller 1', and the temperature sensor 13 for measuring a temperature of the silicon rubber layer 12' is also disposed to the fixing roller 1'.

A fluorine resin layer (polytetrafluoroethylene layer) is sintered into a thickness of approximately 30 $\mu$m on a roller base 21' of aluminum whose outer diameter is 24 mm and has elastic layer 22' applied, thereby defining the pressure/heating roller 2'.

The fixing roller 1' and the pressure/heating roller 2' contact each other under a pressure of 20 kg, thereby defining a nip width.

The image fixing apparatus B is different from the image fixing apparatus A in that the pressure roller 2' heats the fixing roller 1' and also applies a pressure upon a recording medium. Since the image fixing apparatus B needs one driving apparatus fewer, the structure of the image fixing apparatus B is simple and compact.

The image fixing apparatus B as well exhibits an excellent fixing capability.

Figure 4:
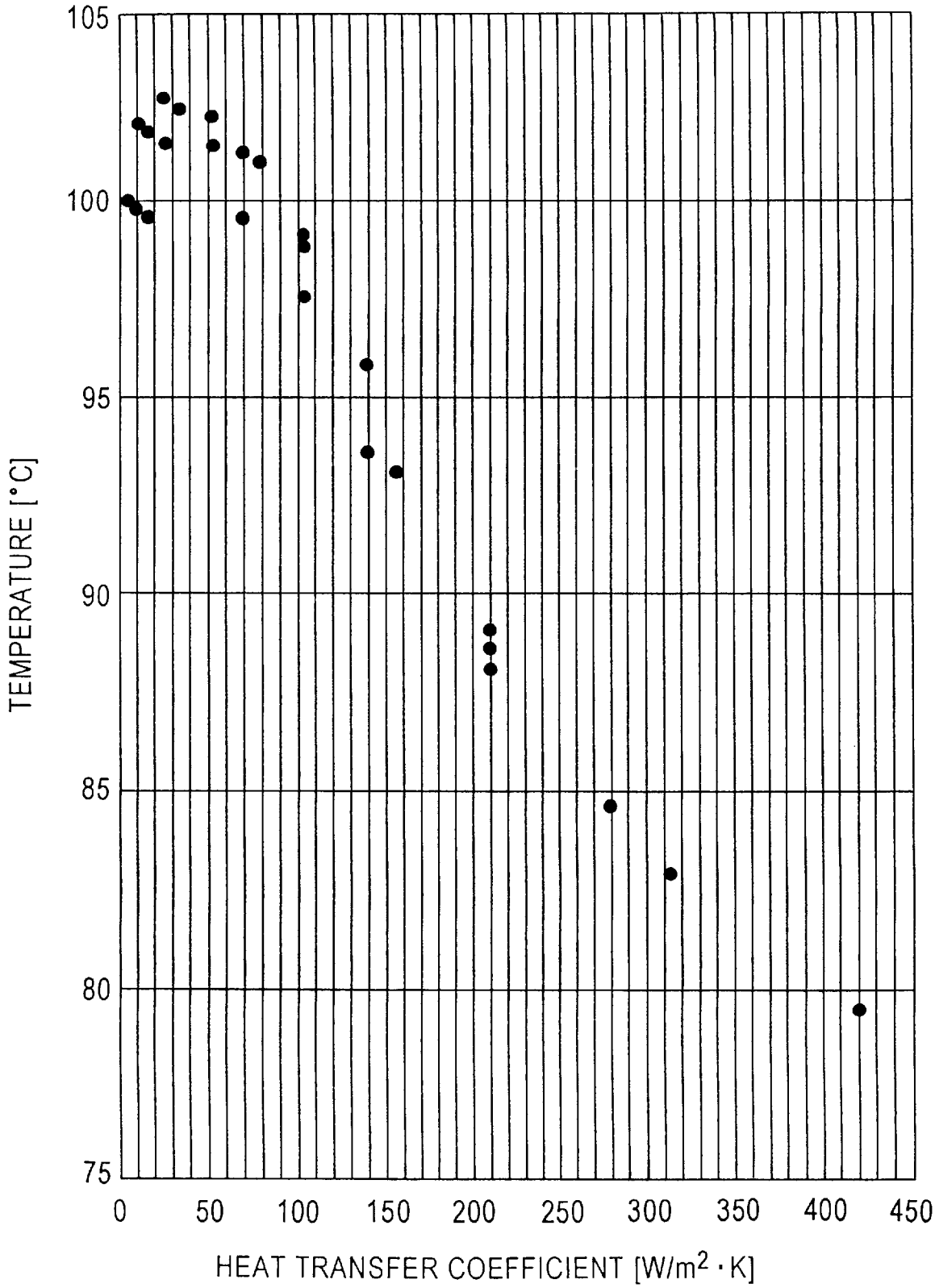
FIG. 4 is a view showing a relationship between a heat transfer coefficient of a surface layer of a fixing roller and a surface temperature of a recording medium during fixing of an image.

An experiment was conducted with respect to the fixing apparatus shown in FIG. 2, in which various types of silicon rubber layers, ranging in thermal conductivity from 0.025 W/m·K to 0.8 W/m·K and in thickness from 1 mm to 4 mm, were prepared as the silicon rubber layer 12' of the fixing roller 1', a heat transfer coefficient of the fixing roller was changed differently, and images were fixed on normal papers which bore toner images each having a weight of 64 g/m$^2$, in an effort to find a relationship between the heat transfer coefficient values of the fixing roller and surface temperatures of the normal papers immediately after fixing of the images. The temperatures were measured using a radiation thermometer. FIG. 4 shows the result. While the higher the temperature, the better the images are fixed at a sufficient fixing strength, FIG. 4 indicates that the surface temperatures of the normal papers immediately after fixing of the images tend to be around 100° C. when the heat transfer coefficient is from 20 W/m$^2$·K to 100 W/m$^2$·K and that the surface temperatures of the recording media are particularly high when the heat transfer coefficient is from 30 W/m$^2$·K to 60 W/m$^2$·K. In other words, an optimal heat transfer coefficient of the fixing member or the surface layer portion of the fixing member is 20 W/m$^2$·K to 100 W/m$^2$·K, and more preferably, 30 W/m$^2$·K to 60 W/m$^2$·K. In addition, an experiment similar to the fixing strength test described earlier was also separately conducted, in which samples whose surface temperatures exceeded 100° C. exhibited an excellent fixing capability.

Figure 3:
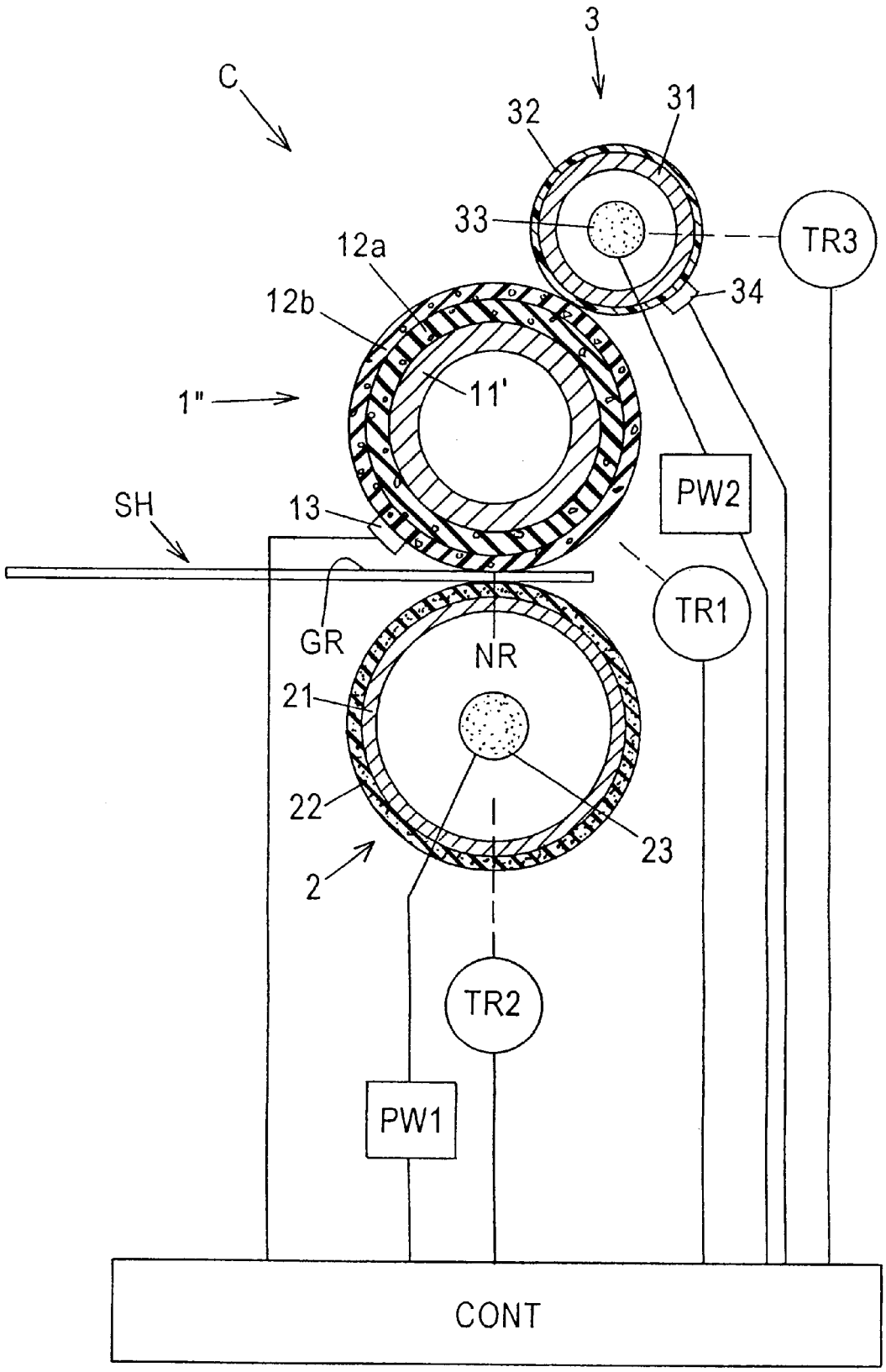
FIG. 3 is a schematic structure diagram showing still other example of an image fixing apparatus according to the present invention.

FIG. 3 shows a schematic structure of still other example of an image fixing apparatus according to the present invention.

An image fixing apparatus C shown in FIG. 3 comprises a fixing roller 1" which contacts an image surface GR of a recording mediums SH and performs fixing, and a pressure roller 2 which is urged against the fixing roller 1" to thereby apply a necessary pressure needed for fixing of a toner image upon the recording medium SH, and the external heating roller 3 which internally comprises a heat source.

The pressure roller 2 and the external heating roller 3 are the same as those shown in FIG. 1. Identical reference symbols are assigned to portions which are substantially the same as those of the image fixing apparatus A.

The fixing roller 1" has a stacked two-layer structure which is obtained by forming a first layer (insulation layer) 12*a* of a silicon sponge whose thickness is 2 mm and whose thermal conductivity is 0.06 W/m·K (a heat transfer coefficient of 30 W/m$^2$·K) on a surface of a solid roller base 11' of iron whose outer diameter is 24 mm, and further forming a second layer 12*b* of a silicon sponge whose thickness is 0.5 mm and whose thermal conductivity is 0.3 W/m·K (a heat transfer coefficient of 600 W/m$^2$·K) on a surface of the first layer. A heat transfer coefficient of the stacked structure as a whose combining the first layer 12*a* and the second layer 12*b* is 29 W/m$^2$·K.

The image fixing apparatus C ensured an excellent fixing capability even when normal papers each seating a toner image and having a weighing capability of 80 g/m$^2$ were fed passing through, twelve papers per minute, at a paper travel speed of 80 mm/sec.

In any one of the image fixing apparatuses A, B and C described above, the driving apparatuses TR1, TR2 and TR3 may each comprise a motor, or alternatively, may have a certain common portion such that, for example, a one common motor drives the driving apparatuses TR1, TR2 and TR3 using a power transmission mechanism such as gears and a belt.

While the image fixing apparatuses A, B and C described above use the fixing rollers 1, 1' and 1" as the fixing member, a fixing belt may be used as the fixing member.

Further, although the external heating roller 3 of the contact type wherein the heat source is disposed inside the roller was described as the external heating apparatus, a non-contact (radiation) type heat source may be used to heat up the surface of the fixing member which may be the fixing roller 1, 1' or 1".

Further, in any one of the image fixing apparatuses A, B and C, cleaning means for the fixing roller, the pressure roller and the like may be additionally disposed.

With the image fixing apparatuses A, B and C described above, it is possible to guarantee a necessary width of the contact nip portion NR which is necessary for fixing of images between the fixing roller 1, 1' or 1" and the pressure roller 2 or 2', without increasing the size of the apparatus or remarkably increasing a contact pressure force at the nip portion NR.

In addition, with the image fixing apparatuses A, B and C described above, it is possible to stably ensure a temperature which is necessary to fix an image on the surface layer of the fixing roller without remarkably increasing the temperature gradient of the surface layer of the fixing roller 1, 1' or 1" (the silicon rubber layer 1 or 1', the second layer 12*b*) or adding a filler, which in turn allows to suppress peeling or thermal deterioration of the surface layer. Hence, it is possible to extend a cycle of maintenance of the fixing roller 1, 1' or 1".

According to the present invention, it is possible to obtain an image fixing apparatus for fixing a toner image formed on a recording medium to the recording medium within an image forming apparatus such as a copier machine, a printer and a facsimile machine, with which it is possible to guarantee a necessary fixing nip width which is needed for fixing of images without increasing the size of the apparatus or remarkably increasing a holding pressure at the fixing nip portion (i.e., without creating an extremely high temperature portion inside the surface layer), and to stably maintain an appropriate fixing temperature without increasing the temperature gradient of the surface layer portion or adding a filler material to the surface layer. This makes it possible to realize stable and high-quality fixing of images one at a time not to mention, but also even continuously.

Although the present invention has been fully described by way of examples with reference to the accompanying drawings, it is to be noted that various changes and modifications will be apparent to those skilled in the art. Therefore, unless such changes and modification depart from the scope of the present invention, they should be construed as being included therein.

What is claimed is:

1. An image fixing apparatus for fixing a toner image on a recording medium, comprising:

a fixing member whose heat transfer coefficient in the direction of thickness is 20 $W/m^2 \cdot K$ to 100 $W/m^2 \cdot K$ and which contacts said toner image; and a heater which heats said fixing member from outside.

2. An image fixing apparatus according to claim 1, wherein said fixing member includes: a base; and a silicon rubber layer which is formed on said base.

3. An image fixing apparatus according to claim 1, wherein said heater is urged against said fixing member to define a nip portion for transforming the recording medium.

4. An image fixing apparatus according to claim 1, further comprising a pressure roller which is urged against said fixing member to define a nip portion for transporting the recording medium.

5. An image fixing apparatus according to claim 4, further comprising a heat source which is disposed inside said pressure roller.

6. An image fixing apparatus according to claim 1, wherein the heat transfer coefficient of said fixing member is 30 $W/m^2 \cdot K$ to 60 $W/m^2 \cdot K$.

7. A an image fixing apparatus for fixing a toner image on a recording medium, comprising:

a fixing member which includes an elastic material layer whose heat transfer coefficient is 20 $W/m^2 \cdot K$ to 100 $W/m^2 \cdot K$ and which contacts said toner image; and a heater which heats said fixing member from outside.

8. An image fixing apparatus according to claim 7, wherein said heater is urged against said fixing member to define a nip portion for transporting the recording medium.

9. An image fixing apparatus according to claim 7, further comprising a pressure roller which is urged against said fixing member to define a nip portion for transporting the recording medium.

10. An image fixing apparatus according to claim 9, further comprising a heat source which is disposed inside said pressure roller.

11. An image fixing apparatus according to claim 7, wherein the heat transfer coefficient of said fixing member is 30 $W/m^2 \cdot K$ to 60 $W/m^2 \cdot K$.

12. An image fixing apparatus for fixing a toner image on a recording medium, comprising:

a fixing member which includes a first layer having an elasticity whose heat transfer coefficient is 50 $W/m^2 \cdot K$ or smaller and a second layer whose heat transfer coefficient is 60 $W/m^2 \cdot K$ or higher and which is formed on said first layer, said fixing member being in contact with said toner image; and a heater which heats said fixing member from outside.

13. An image fixing apparatus according to claim 12, wherein the heat transfer coefficient of said first layer is 30 $W/m^2 \cdot K$ or smaller.

14. An image fixing apparatus according to claim 12, wherein the heat transfer coefficient of said second layer is 600 $W/m^2 \cdot K$ or higher.

15. An image forming apparatus, comprising:

an image forming device which forms a toner image on a recording medium;

a fixing member whose heat transfer coefficient in the direction of thickness is 20 $W/m^2 \cdot K$ to 100 $W/m^2 \cdot K$ and which contacts the toner image; and a heater which heats said fixing member from outside.

16. An image forming apparatus, comprising:

an image forming device which forms a toner image on a recording medium;

a fixing member which includes a first layer having an elasticity whose heat transfer coefficient is 50 $W/m^2 \cdot K$ or smaller and a second layer whose heat transfer coefficient is 60 $W/m^2 \cdot K$ or higher and which is formed on said first layer, said fixing member being in contact with the toner image; and a heater which heats said fixing member from outside.

* * * * *